US008007121B2

(12) United States Patent
Elliott et al.

(10) Patent No.: US 8,007,121 B2
(45) Date of Patent: Aug. 30, 2011

(54) SUPPORT STRUCTURE FOR AN LED DISPLAY SYSTEM

(75) Inventors: Grant Arthur John Elliott, Tai Po (HK); Marcus Robert Patterson, Auckland (NZ)

(73) Assignee: Barco, Inc., Duluth, GA (US)

( * ) Notice: Subject to any disclaimer, the term of this patent is extended or adjusted under 35 U.S.C. 154(b) by 28 days.

(21) Appl. No.: 12/424,360

(22) Filed: Apr. 15, 2009

(65) Prior Publication Data

US 2009/0284978 A1 Nov. 19, 2009

Related U.S. Application Data

(60) Provisional application No. 61/045,227, filed on Apr. 15, 2008.

(51) Int. Cl.
*F21V 21/00* (2006.01)

(52) U.S. Cl. ..... 362/97.1; 362/147; 362/249.06; 362/382; 52/506.06; 52/506.1

(58) Field of Classification Search ..... 52/506.06, 52/605.1, 509, 177; 362/97.1, 147, 249.06, 362/382

See application file for complete search history.

(56) References Cited

U.S. PATENT DOCUMENTS

| | | | | |
|---|---|---|---|---|
| 5,410,328 | A | 4/1995 | Yoksza et al. | |
| 5,946,875 | A * | 9/1999 | Jeanseau | 52/506.08 |
| 6,314,669 | B1 | 11/2001 | Tucker | |
| 6,704,989 | B1 | 3/2004 | Lutz et al. | |
| 6,813,853 | B1 | 11/2004 | Tucker | |
| 7,063,449 | B2 * | 6/2006 | Ward | 362/616 |
| 7,071,620 | B2 | 7/2006 | Devos et al. | |
| 7,102,601 | B2 | 9/2006 | Devos et al. | |
| 2005/0178034 | A1 | 8/2005 | Schubert et al. | |
| 2007/0000849 | A1 | 1/2007 | Lutz et al. | |
| 2008/0037284 | A1 * | 2/2008 | Rudisill | 362/629 |
| 2009/0034241 | A1 * | 2/2009 | Coushaine et al. | 362/145 |

FOREIGN PATENT DOCUMENTS

FR 2797341 A1 2/2001

* cited by examiner

*Primary Examiner* — Laura Tso
(74) *Attorney, Agent, or Firm* — Aka Chan LLP

(57) ABSTRACT

A display system, a light emitting tile, and a method of constructing a display system are provided. In one embodiment, a display system comprises a support structure having a plurality of attachment members, and a plurality of tiles. Each of the plurality of tiles has an attachment point configured to couple to one of the plurality of attachment members. Furthermore, at least one of the plurality of tiles includes at least one connection configured to couple and align the at least one of the plurality of tiles to another one of the plurality of tiles.

20 Claims, 13 Drawing Sheets

SUPPORT STRUCTURE FOR AN LED DISPLAY SYSTEM

CROSS-REFERENCE TO RELATED APPLICATIONS

The present application claims priority to U.S. Provisional Application No. 61/045,227, filed Apr. 15, 2008, the full disclosure of which is incorporated by reference herein for all purposes.

The present application is related to co-pending U.S. patent application Ser. No. 12/424,338 filed concurrently herewith as by the same inventors and incorporated by reference herein for all purposes.

TECHNICAL FIELD OF THE DISCLOSURE

This disclosure generally relates to display units and particularly to a display system comprising groups of light emitting elements mounted to a support structure such that the display system may be easily installed and/or reconfigured while retaining both strength and positional accuracy.

BACKGROUND OF THE DISCLOSURE

Display systems for entertainment, architectural, and advertising purposes have commonly been constructed of numbers of light emitting elements such as LEDs or incandescent lamps mounted onto flat tiles. The light emitting elements can be selectively turned on and off to create patterns, graphics, and/or video displays for both informational and aesthetic purposes. It is well known to construct these displays as tiles or large panels which are assembled in position for a specific entertainment show or event or as an architectural or advertising display. Examples of such systems are disclosed in U.S. Pat. Nos. 6,813,853, 6,704,989 and 6,314,669, the disclosures of which are incorporated by reference herein for all purposes.

It can be a requirement of an event or theatrical production to use such a display but to have the display easily removable, for example in between scenes of a play or theatrical event, as the needs of the production dictate. Systems may use a tile based structure where a tile, typically around 2 ft×2 ft, can be lifted by hand and positioned. Accurate positioning of the tiles may be a time consuming and complex process involving skilled personnel.

Displays of these types may be constructed at different resolutions where the spacing between the light emitting elements can be varied. It may also be a requirement to change this spacing at different points on the display. Such systems are disclosed in U.S. Pat. Nos. 5,410,328, 7,102,601 and 7,071,620, the disclosures of which are incorporated by reference herein for all purposes. Further prior art systems, such as the VersaPixel manufactured by Element Labs, Inc. or the MiSphere system manufactured by Barco, may use suspended light emitting elements to be used as a ceiling or roof to an area. It would be advantageous to have a support and installation structure for such displays that is simple to install and that facilitates use in differing resolutions and on different planes through a single structure.

Small errors in the positioning of the pixels within tiles and tiles within a display can be cumulative and may lead to large errors in overall pixel alignment accuracy. At the same time the display support system must be strong enough to support a large area of display tiles and to withstand side loads from wind and weather if used outside. The goal of simultaneous strength, rigidity and accuracy is one that is commonly not achieved in prior art systems and the user typically has to accept a reduced accuracy in order to achieve the required strength. Accordingly, there exists a need for a display system that may be easily installed and/or reconfigured while retaining both strength and positional accuracy.

DETAILED DESCRIPTION

Figure 1:
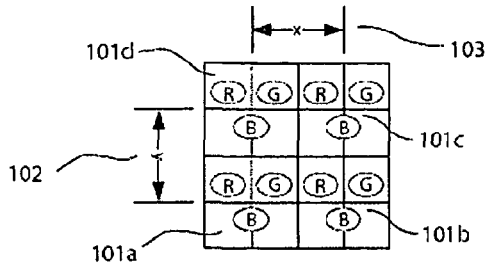
FIG. 1 shows pixels of a prior display system.

FIG. 1 shows pixels of a display system in accordance with the prior art. Each pixel 101*a*, 101*b*, 101*c*, 101*d* may be constructed from 3 LEDs; e.g., red (R), green (G) and blue (B). The distance 103 and 102 between the center of a pixel and its adjacent pixels is referred to as the pixel pitch. The x-axis pixel pitch 103 may be substantially the same as the y-axis pixel pitch 102.

In a large display with a large number of pixels it is critical that the pixel pitch is controlled within tight tolerances. Errors in the pixel pitch across the display are very apparent to the viewer and adversely affect the image quality.

Figure 2:
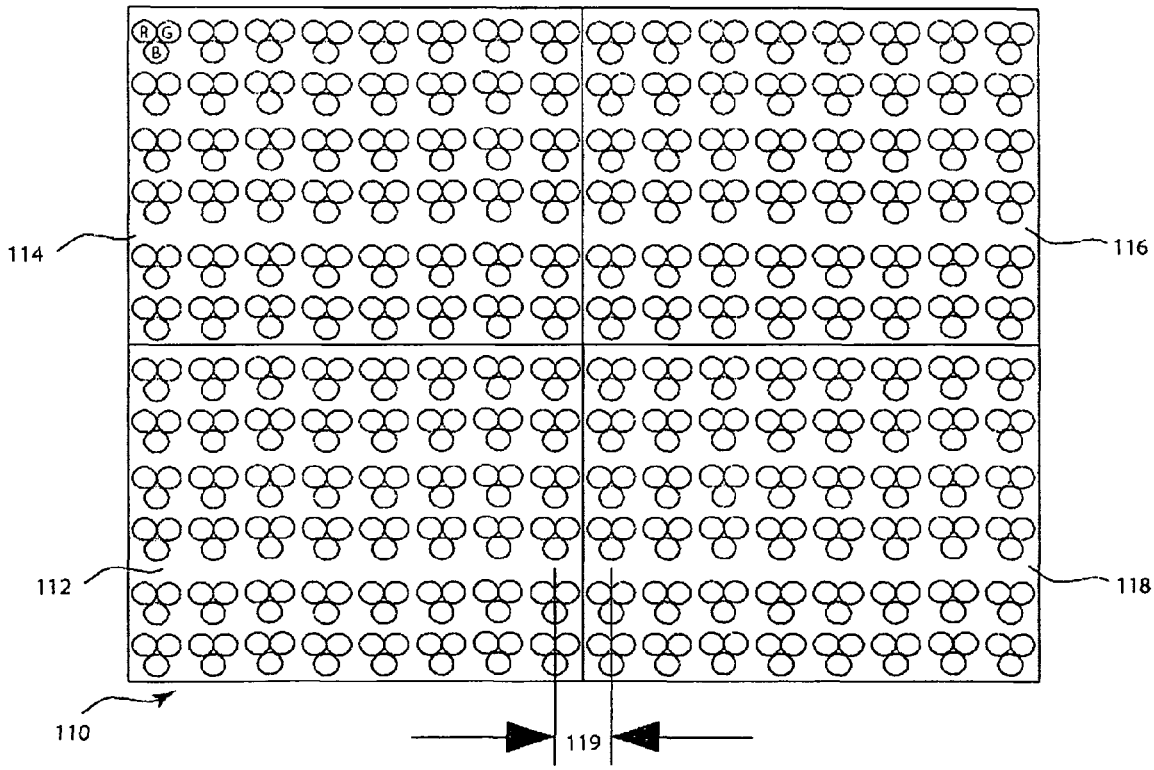
FIG. 2 shows a portion of a prior modular display system.

FIG. 2 illustrates a portion of a modular display system 110 in accordance with the prior art, where display modules 112, 114, 116, 118 are mounted adjacent to each other to form a single display. Methods to control pixel alignment and pitch within a single module are well known in the art through such means as accurate component placement on a printed circuit board within the module housing. The modules may be constructed from plastic, and be sufficiently small that the tolerances within the modules can be tightly controlled.

However the pitch 119 between the pixels on adjacent modules is controlled by the accurate mechanical alignment and spacing of the individual modules. If this alignment and spacing is not accurately maintained gaps may appear in the display which appear darker when the screen is set to black. Additionally, banding can appear due to perceived luminance errors. For example, if the pixel pitch between modules is greater than the pixel pitch within the module, then the effective area subtended to the viewer by the pixels at the boundary is larger than those within the module. This increased effective area causes the perceived luminance of the pixels at the boundaries of the modules to be lower than the pixels within the module causing an apparent band or stripe in the image.

In the prior art, modular display systems may include a number of display modules mounted onto a larger tile in which these tiles are connected together to form the entire screen. The tiles are typically constructed from folded sheet metal, and are large compared to the modules. These tiles and their interconnection provide both the alignment of the display modules and the structural support and strength to form the mechanical infrastructure of the screen. If a screen is intended for an outdoor application then it must further be able to withstand wind loadings producing significant sideways forces.

Figure 3:
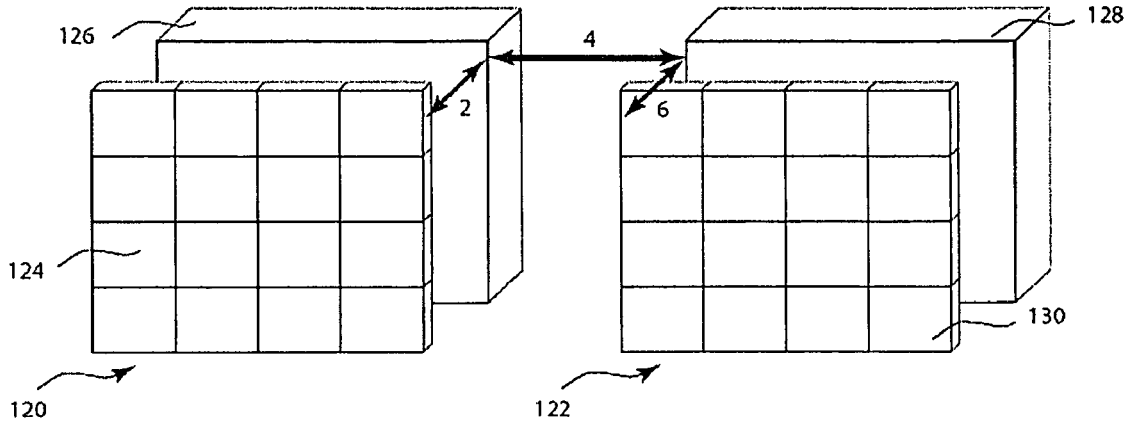
FIG. 3 shows a prior modular display system.

FIG. 3 shows a modular display system in accordance with the prior art. A plurality of display modules 124 are assembled onto a support structure 126 to form tile 120, and a second plurality of display modules 130 are assembled onto support structure 128 to form a second tile 122. Support structures 126 and 128 are interconnected to support and align the two tiles. The alignment of the display modules 124 on tile 120 with display modules 130 on tile 122 are affected by multiple and cumulative tolerances: tolerance 2 between tile 120 and support structure 126, tolerance 4 between support structure 126 and support structure 128, and tolerance 6 between support structure 128 and tile 122.

In the prior art system such tolerances may accumulate and produce a total positional error as high as ±8.25% (total 16.5%) resulting in visible and objectionable luminance difference between the pixels at the tile boundaries and the pixels within the tile. Such a gap between tiles will be noticeable to an observer and detract from a cohesive look. Although here we are referring to tolerances in a single axis, it is also important to note that these tolerances may be present and important in all three perpendicular axes x, y, and z.

The prior art uses the support structure 126, 128 to provide both:

alignment—ensuring that the tiles align to form a cohesive display; and structural support—ensuring that the screen can support itself safely as well as endure additional forces, such as from wind loading in outdoor situations.

Alignment accuracy is the primary requirement for display quality, but the large structural parts needed to simultaneously achieve the strength goals may hinder that accuracy. Achieving the tight tolerances needed with large structural components can be difficult and expensive, and almost always involves large amounts of time consuming and expensive machining.

Figure 4:
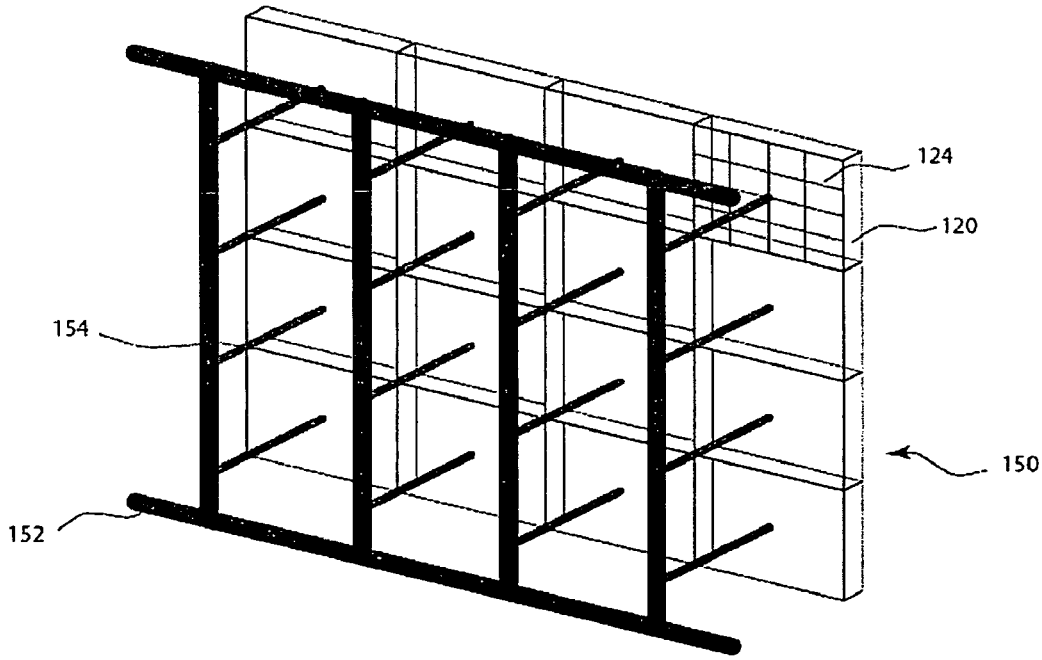
FIG. 4 shows a display system in accordance with embodiments of the present disclosure.

The present disclosure improves on the prior art and discloses means for assembling a modular display which isolate the alignment and structural requirements/functionality from each other. FIG. 4 shows a display system 150 in accordance with embodiments of the present disclosure. Multiple display modules 124 are assembled onto a plurality of tiles 120 (without the use of support structures 126, 128). Tiles 120 may connect to adjacent tiles through at least one connection that may include clips or clamps which provide accurate and improved alignment without having a requirement (or a substantially low requirement) to provide support or strength to the system. Substantially removing the strength requirement from these components allows smaller, more accurately manufactured parts to be used and ensure highly accurate alignment. The tiles may be manufactured using injection molding or other techniques well known in the art which have inherently high levels of accuracy, as compared to the sheet metal and machining techniques used in the prior art. Thus, the video display will be accurately aligned and cohesive in its appearance.

Structural support and strength is provided though a secondary structural support 152 which is connected to the display tiles through attachment member 154 such that the alignment of the display tiles remains uncompromised. In one example, attachment member 154 includes an interconnecting member, such as a rod, and a spigot at the end of the rod, which operably couples to a tile 120. The secondary structural support 152 provides the strength required to support itself and the display tiles and to resist other applied forces such as wind loading.

To ensure that any inaccurate alignment of structural support 152 does not compromise or affect the alignment of the display tiles 120, the attachment members 154 may be constructed so as to take up or nullify any tolerance difference between the accurately aligned display tiles 120 and the structural support 152. Alignment accuracies up to an order of magnitude better than the prior art system can be provided by the separation of the functions of alignment and support. For example, in one embodiment, the attachment member 154 may be moveable or deformable in any direction with respect to the structural support 152.

Figure 5:
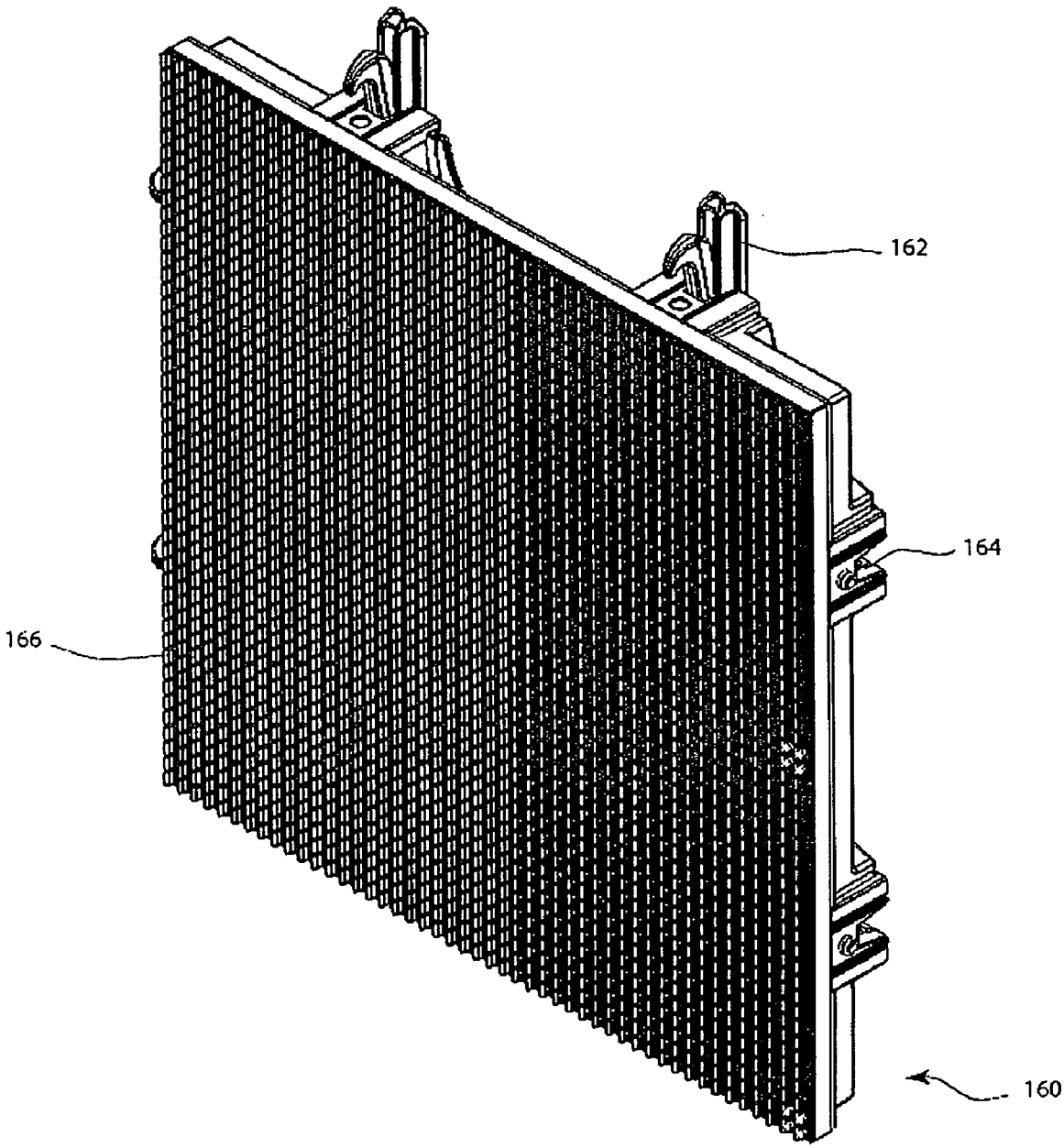
FIG. 5 shows an isometric view of a tile of a display system in accordance with embodiments of the present disclosure.

FIG. 5 shows an isometric view of a tile 160 of a display system in accordance with embodiments of the present disclosure. A plurality of pixels 166 are mounted onto a display tile 160. Display tile 160 is accurately constructed to very tight tolerances and may use injection molding or other inherently accurate manufacturing technique. The strength requirement for tile 160 is minimal, as it only needs to support itself and the attached pixels and associated circuitry. There is no requirement to provide support for adjacent tiles. Alignment between adjacent tiles 160 is provided through connections such as clips 162 and receptacles 164 in one example. Clips 162 and receptacles 164 provide highly accurate alignment of adjacent tiles 160 with no or a substantially low requirement to transmit support or strength between those tiles. This allows the use of accurate construction to very tight tolerances which may use injection molding or other inherently accurate manufacturing technique.

Figure 6:
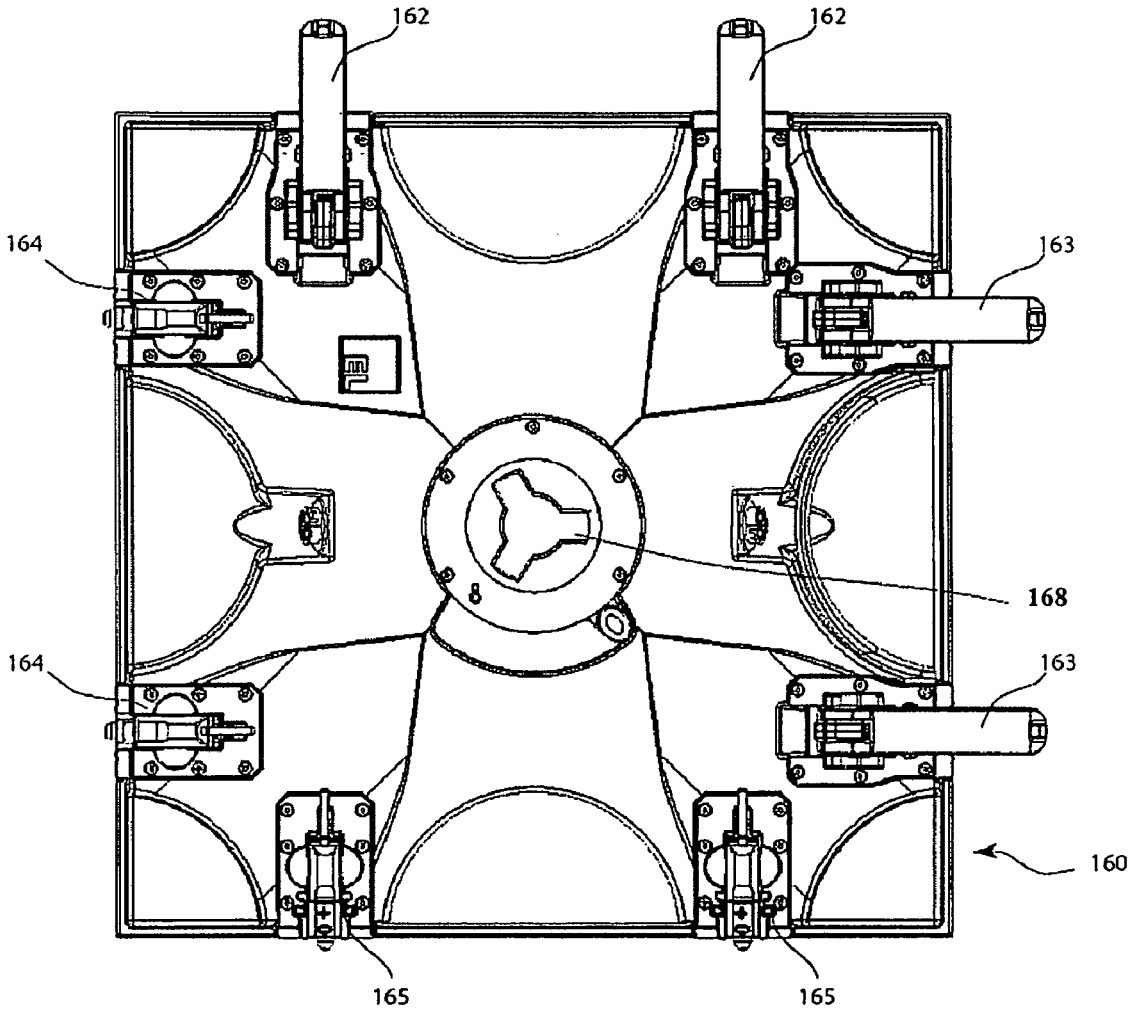
FIG. 6 shows a rear view of a tile of a display system in accordance with embodiments of the present disclosure.

FIG. 6 shows a rear view of a tile of a display system in accordance with embodiments of the present disclosure. Clips 162 on the top of a tile may connect to receptacles 165 on the bottom of the adjacent tile. Similarly clips 163 on the right of a tile may connect to receptacles 164 on the left side of the adjacent tile. Strength and support for tile 160 is provided through center attachment point 168 which connects to the attachment member 154 (FIG. 4) back to the structural support 152 (FIG. 4). Through such means a modular display of any size may be quickly and accurately constructed.

Figure 7:
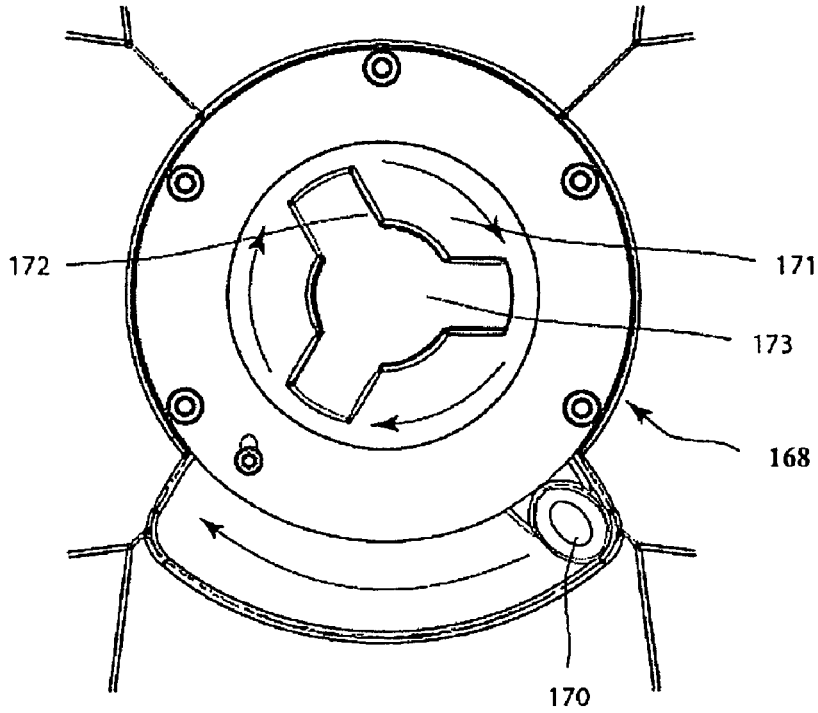
FIG. 7 shows a portion of a tile of a display system in accordance with embodiments of the present disclosure.

FIG. 7 shows a portion of a tile of a display system in accordance with embodiments of the present disclosure having an attachment point 168. In one example, attachment point 168 includes a locking and support mounting socket comprising two plates with trilobular apertures: a lower fixed plate 172 and an upper movable plate 171. Upper movable plate 171 is attached to operating handle 170 and may be angularly rotated about the center of the aperture. FIG. 7 illustrates the mounting mechanism in its open and unlocked position where the trilobular aperture in movable plate 171 is substantially aligned with the trilobular aperture in fixed plate 172.

Figure 8:
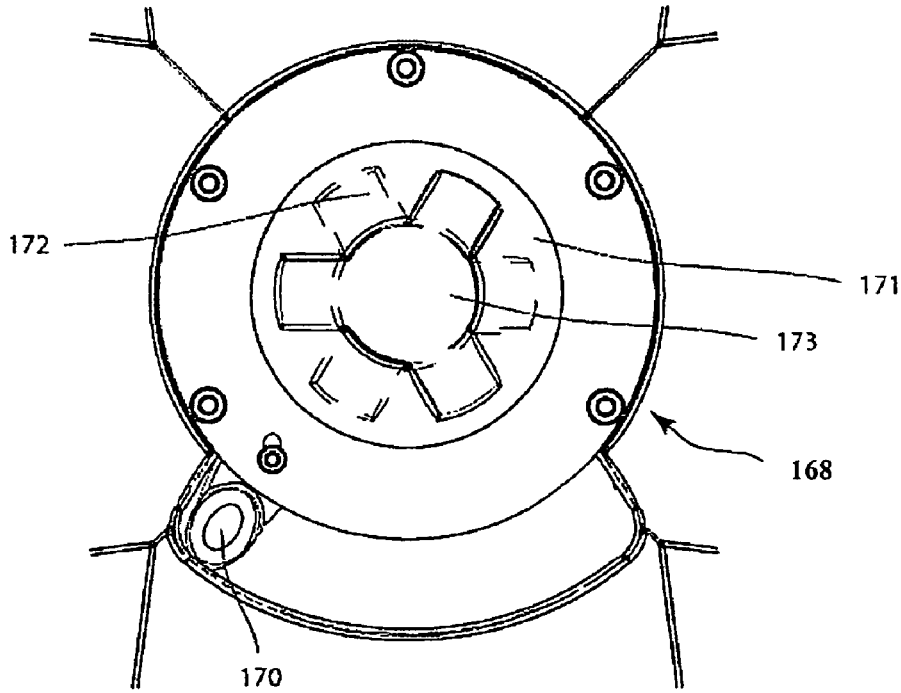
FIG. 8 shows a portion of a tile of a display system in accordance with embodiments of the present disclosure.

FIG. 8 shows a portion of a tile of a display system in accordance with embodiments of the present disclosure having an attachment point 168. As shown the attachment point 168 includes a mounting socket mechanism in its closed and locked position where movable plate 171 has been rotated by means of operating handle 170 such that the trilobular aperture in movable plate 171 is offset from the trilobular aperture in fixed plate 172. Movable plate 171 may be retained in its rotated locked position by means of spring loaded clips, cams, over-center latches or other mechanisms well known in the art.

Figure 9:
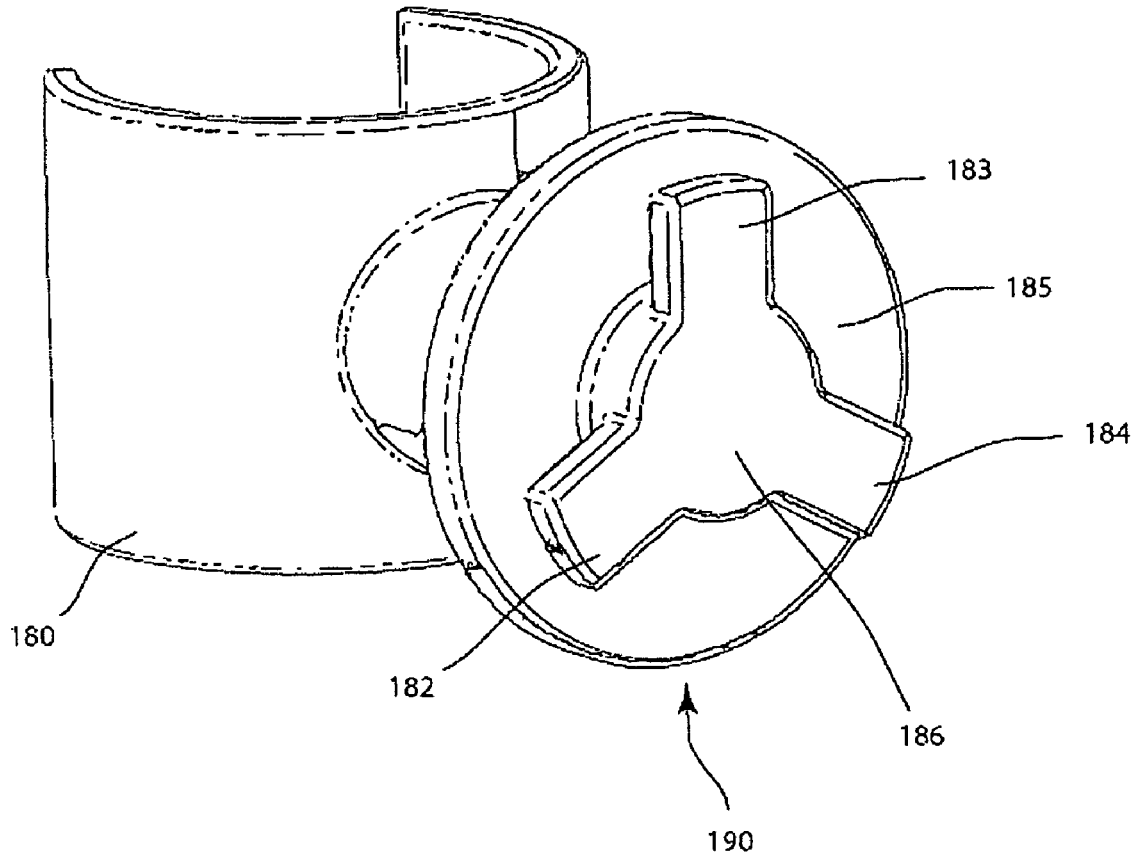
FIG. 9 shows an attachment member in accordance with embodiments of the present disclosure.

Referring now to FIG. 9 in conjunction with FIGS. 7 and 8, FIG. 9 shows an attachment member in accordance with embodiments of the present disclosure. As shown, the attachment member may include a mounting spigot 190 that may be part of the attachment member 154. Mounting spigot 190 comprises a trilobular plate 186 with lobes 182, 183 and 184. Trilobtilar plate 186 is substantially the same size and shape as the trilobular apertures in plates 171 and 172 of center attachment point 168. On one end of the attachment member is an attachment piece 180. The attachment member includes a part 185 between trilobular plate 186 and attachment piece 180.

To connect the mounting spigot to the mounting socket, the movable plate 171 of the mounting socket is rotated to its open and unlocked position as illustrated in and described with respect to FIG. 7. Trilobular plate 186 is inserted into the apertures in the movable plate 171 and fixed plate 172 such that it impinges on a back plate 173. In one example, fixed plate 172 is spaced from back plate 173 such that when trilobular plate 186 impinges on back plate 173 the upper surface of trilobular plate 186 is coplanar with the upper surface of fixed plate 172. After insertion of the trilobular plate 186, movable plate 171 is rotated by means of operating handle 170 into the closed and locked position as illustrated in and described with respect to FIG. 8. In this position the lobes 182, 183, 184 of trilobular plate 186 are securely engaged between backing plate 173 and movable plate 171 and prevented from movement in all linear axes. Trilobular plate 186 is further retained against rotation by the engagement of the trilobular lobes 183, 183, 184 in the trilobular aperture in fixed plate 172. Any or all of the backing plate 173, fixed plate 172 and movable plate 171 may be retained by spring pressure to assist with accurate retention of trilobular plate 186. Through these mechanisms a display tile is securely and rigidly mounted to a mounting spigot 190 and thus attachment member 154 with one action and is simultaneously constrained from movement in three linear axes and rotation about mounting spigot 190.

Figure 10:
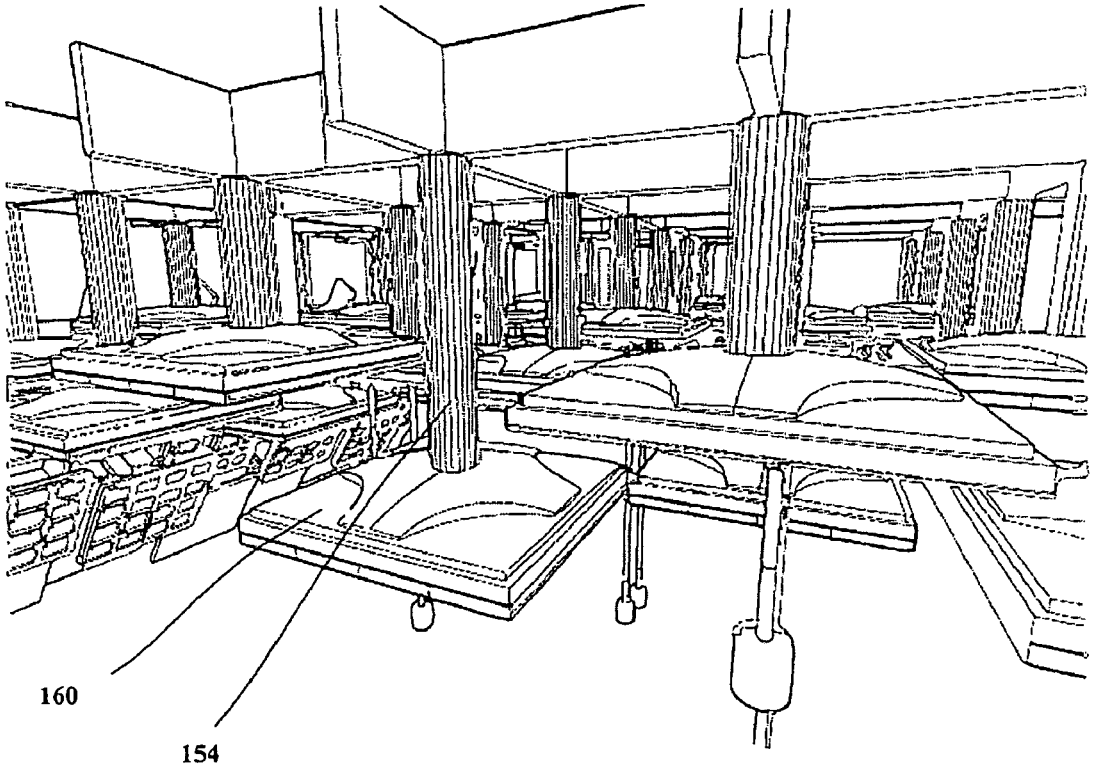
FIG. 10 shows a display system in accordance with embodiments of the present disclosure.

FIG. 10 shows a display system in accordance with embodiments of the present disclosure. In this embodiment, an arrangement of tiles may use mounting sockets and spigots to attach the tiles to a support structure. The mounting system described may further be used as a means of supporting display tiles in irregular arrangements. Tiles 160 are connected to attachment members 154 through mounting spigots and sockets as described herein. This provides simple, quick, secure and accurate installation and removal of tiles in a system and facilitates maintenance of the tiles.

In certain embodiments, the tiles (e.g., tiles 120 or 160) may include a Printed Circuit Board (PCB) that allows a plurality of light emitting elements to be electronically connected to the tile. Further, in certain embodiments, the display system 150 (FIG. 4) may also include a power unit and/or a main processor that is electronically connected to the plurality of light emitting elements. As such, the power unit and/or the main processor may send a data and/or power signal to the plurality of light emitting elements disposed on the tiles. Based on the power signal, the plurality of light emitting elements may be selectively powered on and off or emit light with varying intensities, and based on the data signal, the plurality of light emitting elements may selectively emit light of different colors.

FIGS. 11-15 show several views of a display tile in accordance with embodiments of the present disclosure herein. Specifically, FIGS. 11-15 show various views of the alignment and the construction of multiple elements of the display tile. These views may assist in the manufacturing and assembly of a display tile, and a display system, in accordance with the above disclosure, and to assist and supplement the above embodiments.

Figure 11:
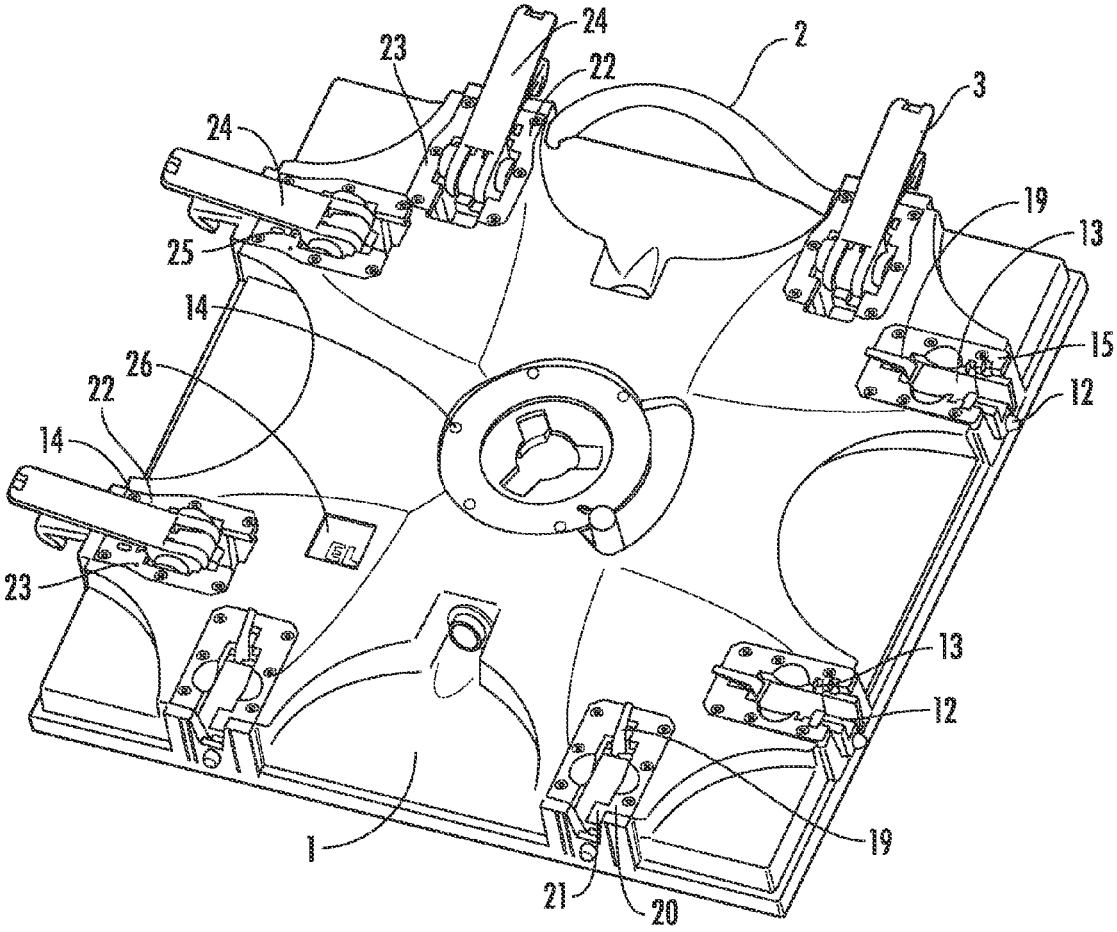
FIGS. 11-15 show various views of a display tile in accordance with embodiments of the present disclosure.

FIG. 11 shows a view of an embodiment of a tile of a display system. Tile 1 has clips 3 and 24 which are secured by parts 22 and 23, which are held in place by screws 14. A part 25 (which is shown in more detail in FIG. 13) is inserted into the tile with the clip. There are receptacles (including parts 12, 13, 15, 19, 20, 21). An attachment point is held in place by screws 14. A part 2 is included in the tile. The tile has an optional "EL" marking 26.

Figure 12:
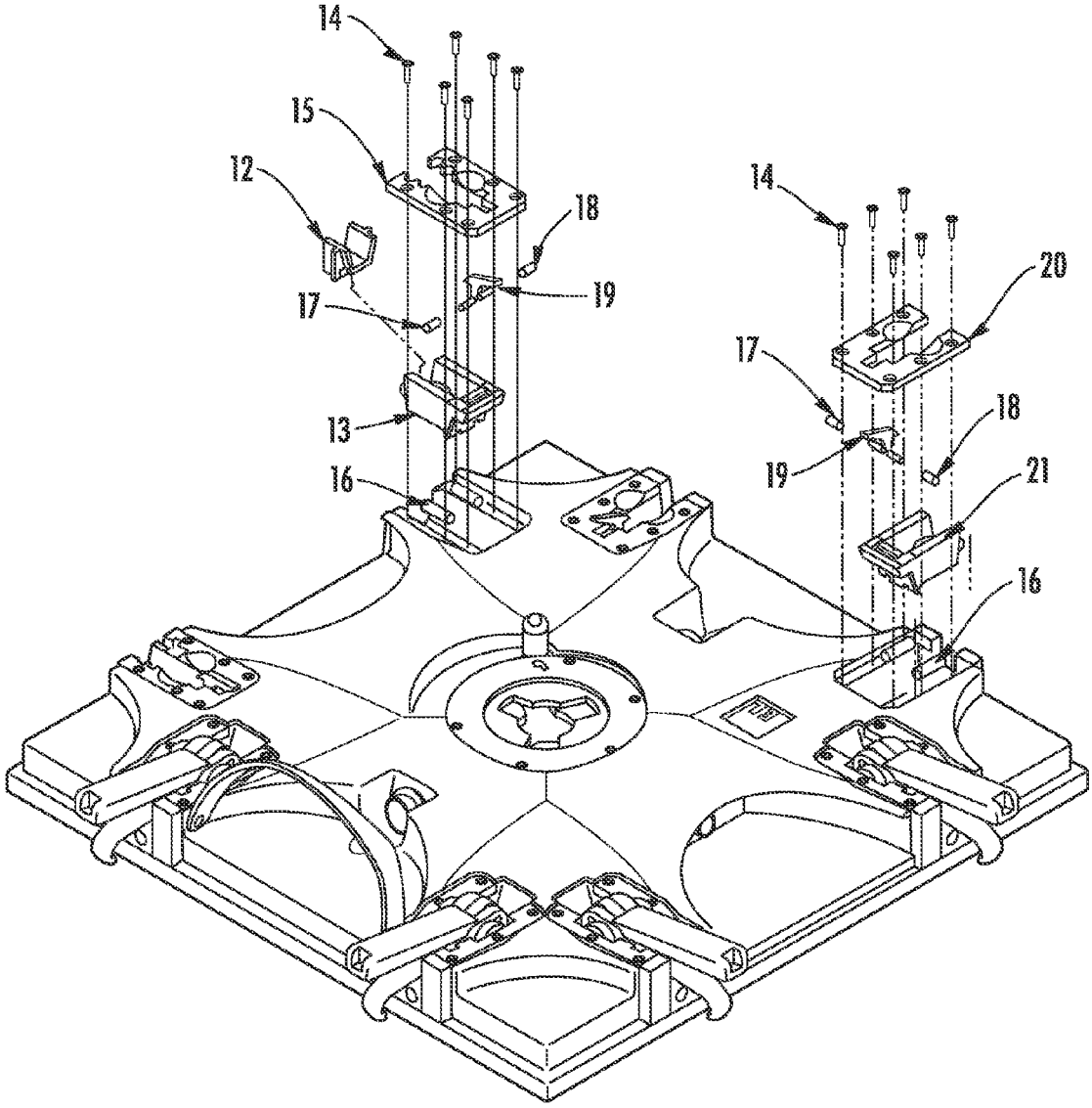

FIG. 12 shows an exploded view of the receptacle of the tile. The upper portion of receptacle 15 and 20 and lower portion of receptacle 13 and 21 are secured using screws 14. A piece 12 is placed at the opening of the receptacle. Inside the receptacle, pins 17 and 18 are used to position hook 19.

Figure 13:
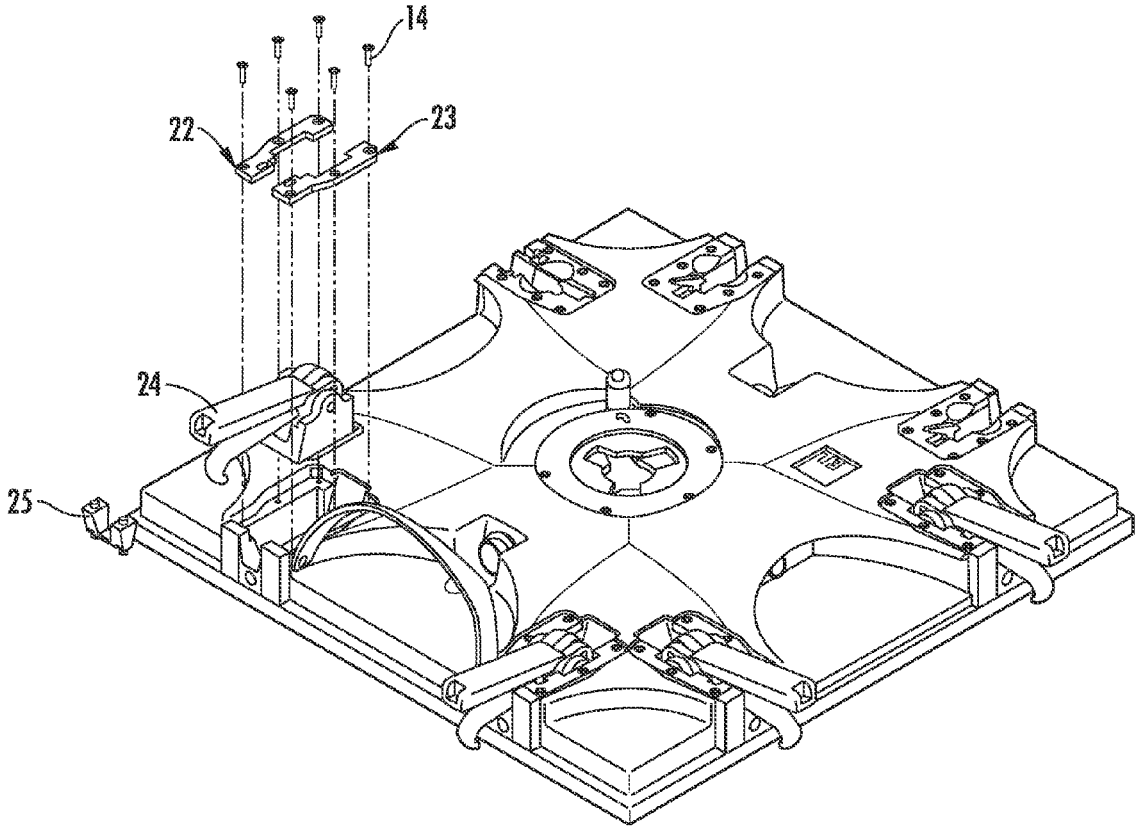
Figure 14:
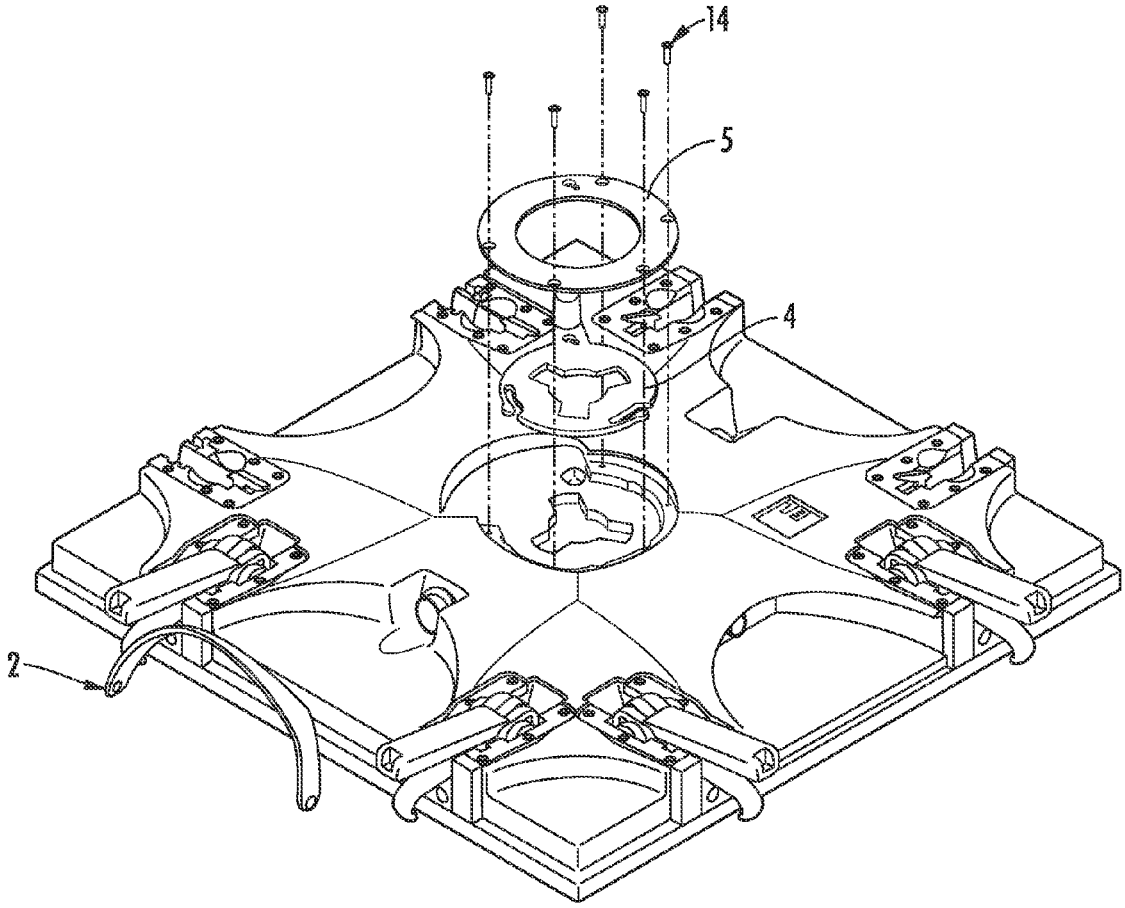
Figure 15:
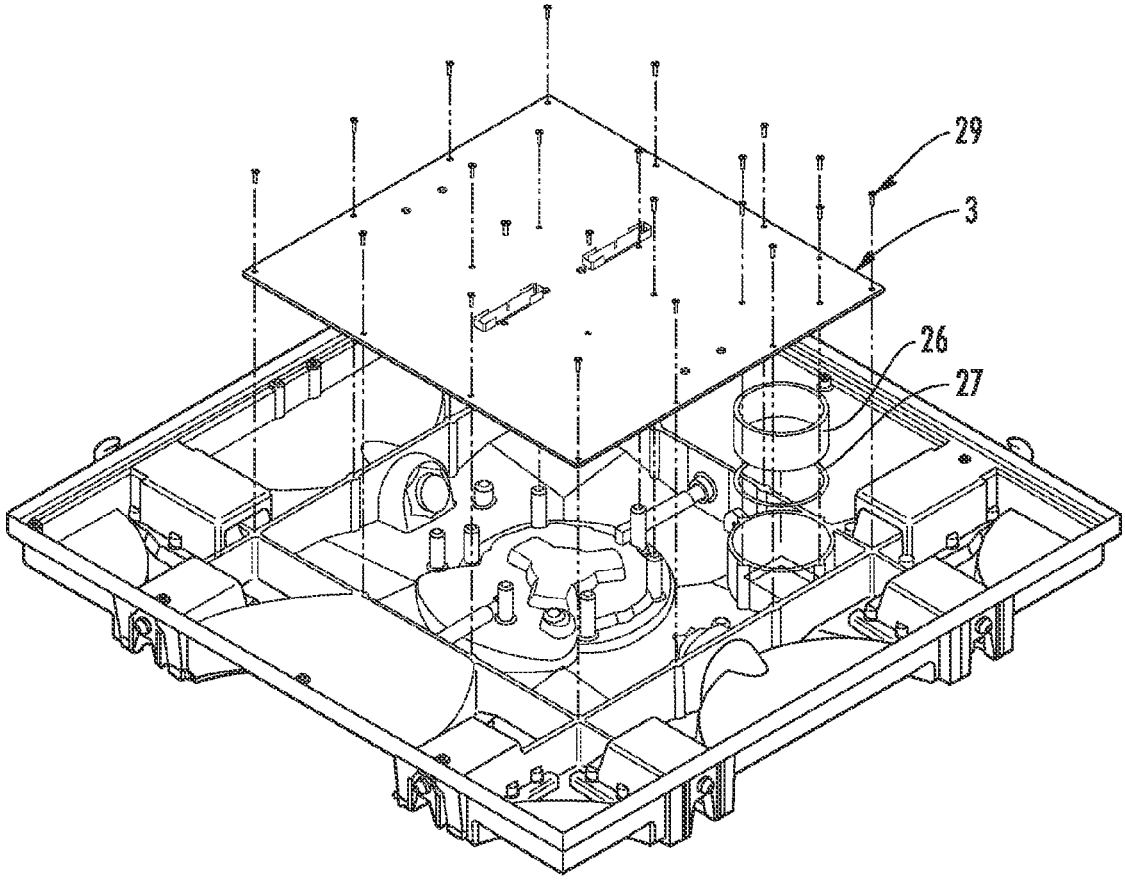

FIG. 13 shows an exploded view of the clip of the tile. The upper portion of clip 22 and 23 secures the body of clip 24 onto the tile by screws 14. FIG. 14 shows an exploded up view of the plates of the tile. A lower plate 4 is placed onto the tile and an upper plate 5 is secured on top of it with screws 14. FIG. 15 shows the front of the plate. A piece 3 is secured onto the tile by screws 29. Two pieces 26 and 27 are placed in the area between piece 3 and the tile.

Figure 16:
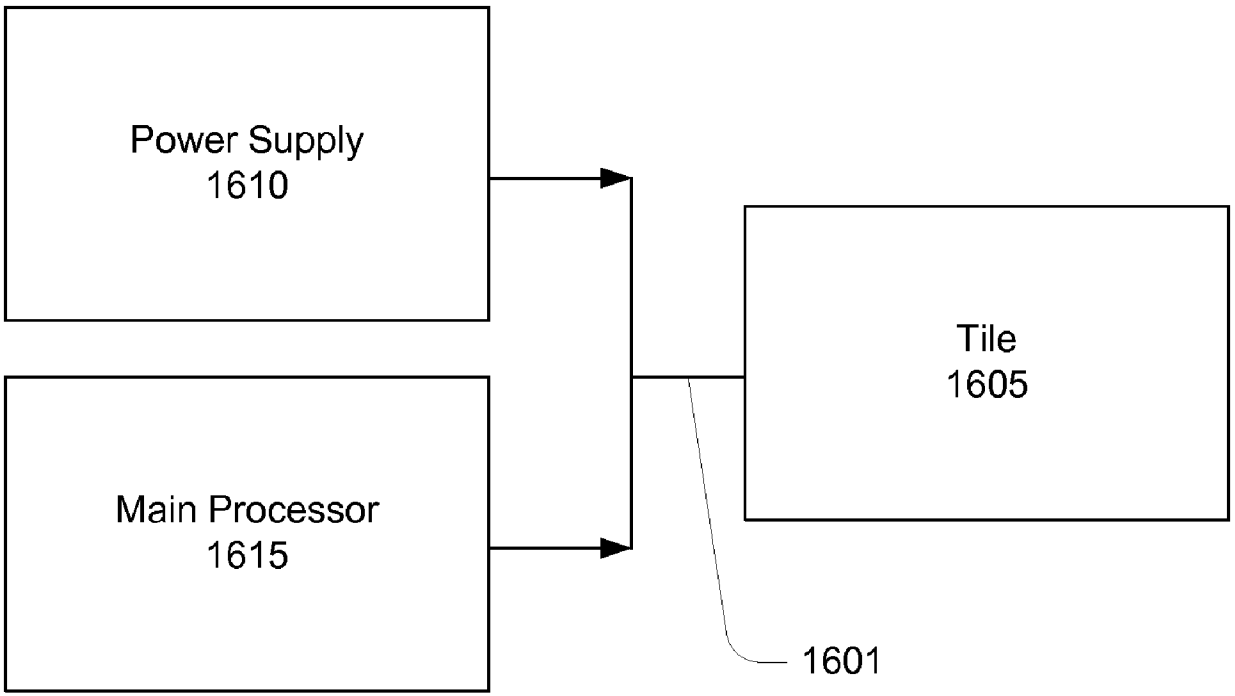
FIG. 16 shows at least one electrical connection, power supply, and main processor.

FIG. 16 shows at least one electrical connection 1601 configured to connect a tile 1605 to a power supply 1610 and/or a main processor 1615.

Advantageously, the present disclosure provides a comprehensive display system and support structure capable of providing both strength and rigidity while also presenting a high level of accuracy for tile and pixel placement.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A display system, comprising:

a support structure having a plurality of attachment members; and a plurality of tiles, each of the plurality of tiles having an attachment point configured to couple to one of the plurality of attachment members, wherein at least one of the plurality of tiles includes at least one connection configured to couple and align the at least one of the plurality of tiles to another one of the plurality of tiles, the attachment point comprises two plates, each plate having an aperture configured to receive at least one attachment member of the support structure, and at least one of the two plates is configured to rotate to an unlocked position and a locked position.

2. The display system of claim 1, wherein the at least one connection includes at least one of clips, receptacles, and clamps.

3. The display system of claim 1, wherein the at least one connection includes at least one of an alignment pin and an opening.

4. The display system of claim 1, wherein at least one of the plurality of attachment members includes a spigot.

5. The display system of claim 1, wherein at least one of the plurality of tiles includes a plurality of display modules.

6. The display system of claim 5, wherein the at least one of the plurality of display modules includes at least one light emitting device.

7. The display system of claim 1, wherein the attachment point is configured to removably couple the at least one tile to at least one attachment member of the support structure.

8. A light emitting tile, comprising:

at least one attachment point configured to couple the light emitting tile to an attachment member of a support structure,.

wherein the at least one attachment point includes at least two plates, each plate having an aperture configured to receive the attachment member, and at least one of the two plates is configured to be moved to an unlocked position; and a plurality of connections configured to removably attach and align the light emitting tile with at least one adjacent light emitting tile.

9. The light emitting tile of claim 8, wherein the at least one attachment point is positioned proximate the center of the light emitting tile.

10. The light emitting tile of claim 8, wherein the attachment member includes a spigot.

11. The light emitting tile of claim 8, further comprising at least one electrical connection configured to electrically couple the light emitting tile to one of a power supply and a main processor.

12. A method of constructing a display system, the method comprising:

providing a support structure having a plurality of attachment members;

providing a plurality of tiles, each of the plurality of tiles having an attachment point, wherein the attachment point includes two plates, each plate having an aperture configured to receive an attachment member;

removably attaching one of the plurality of tiles to one of the plurality of attachment members;

rotating at least one of the two plates to a locked position; and coupling at least one of the plurality of tiles to an adjacent tile with at least one connection, wherein the at least one connection aligns the at least one of the plurality of tiles with the adjacent tile.

13. The method of claim 12, further comprising attaching a plurality of display modules having a plurality of light emitting elements to each of the plurality of tiles.

14. The method of claim 12, further comprising attaching the at least one of the plurality of tiles to an adjacent tile with a second connection, wherein the second connection assists in aligning the at least one of the plurality of tiles with the adjacent tile.

15. The method of claim 12, further comprising electrically connecting the plurality of tiles to at least one of a power supply and a main processor.

16. The method of claim 15, further comprising sending a signal from at least one of the power supply and the main processor to the plurality of tiles, wherein a light emitting device that is coupled to at least one of the plurality of tiles is configured to emit light based on the signal.

17. The display system of claim 1 wherein each tile of the plurality of tiles couples seamlessly to adjacent tiles.

18. The display system of claim 1 wherein each pixel of one of the plurality of tiles comprises at least three lighting elements, each having a different color.

19. The light emitting tile of claim 8 wherein at least one of the two plates is configured to moved to an locked position.

20. The method of constructing a display system of claim 12 comprising:

changing at least one of the two plates to an unlocked position.

* * * * *